US011694652B2

(12) United States Patent
Jeong et al.

(10) Patent No.: US 11,694,652 B2
(45) Date of Patent: Jul. 4, 2023

(54) DATA INTERFACE DEVICE AND METHOD OF DISPLAY APPARATUS

(71) Applicant: LG Display Co., Ltd., Seoul (KR)

(72) Inventors: Yang Seok Jeong, Paju-si (KR); Young Ho Kim, Paju-si (KR); Dong In Noh, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/388,534

(22) Filed: Jul. 29, 2021

(65) Prior Publication Data

US 2022/0044652 A1 Feb. 10, 2022

(30) Foreign Application Priority Data

Aug. 4, 2020 (KR) ..... 10-2020-0097520

(51) Int. Cl.
*G09G 5/00* (2006.01)
*G09G 3/20* (2006.01)

(52) U.S. Cl.
CPC ..... *G09G 5/008* (2013.01); *G09G 3/2096* (2013.01); *G09G 2370/08* (2013.01); *G09G 2370/10* (2013.01)

(58) Field of Classification Search
CPC .. G09G 5/008; G09G 3/2096; G09G 2370/08; G09G 2370/10
USPC ..... 345/204
See application file for complete search history.

(56) References Cited

U.S. PATENT DOCUMENTS

| | | | | |
|---|---|---|---|---|
| 8,279,215 | B2 | 10/2012 | Nam et al. | |
| 2009/0167750 | A1* | 7/2009 | Hong | G09G 3/2096 345/213 |
| 2010/0066723 | A1* | 3/2010 | Nam | G09G 3/3648 345/213 |
| 2013/0002621 | A1 | 1/2013 | Chen et al. | |
| 2015/0187315 | A1 | 7/2015 | Park | |
| 2017/0094287 | A1 | 3/2017 | Nakajima | |
| 2020/0184877 | A1* | 6/2020 | Pyun | G09G 3/2092 |

(Continued)

FOREIGN PATENT DOCUMENTS

| | | | |
|---|---|---|---|
| CN | 101676981 | A | 3/2010 |
| KR | 10-2012-0135805 | A | 12/2012 |
| KR | 10-2013-0009496 | A | 1/2013 |

(Continued)

OTHER PUBLICATIONS

Office Action dated May 23, 2022, issued in corresponding Taiwanese Patent Application No. 110125753.

*Primary Examiner* — Jonathan M Blancha
(74) *Attorney, Agent, or Firm* — Morgan, Lewis & Bockius LLP

(57) ABSTRACT

Disclosed herein is a data interface device of a display apparatus including a timing controller, encoding clock-embedded image data corresponding to a logic high period of a data enable signal and clock-embedded blank data corresponding to a logic low period of the data enable signal and transferring an encoded data transfer packet to a transfer line, and a source integrated circuit generating an internal clock based on the encoded data transfer packet received through the transfer line and selectively decoding the clock-embedded image data based on the internal clock, wherein a transition pattern of the clock-embedded blank data differs in a plurality of transfer lines.

16 Claims, 16 Drawing Sheets

(56) References Cited

U.S. PATENT DOCUMENTS

2020/0251036 A1* 8/2020 Kim ..... G09G 5/008

FOREIGN PATENT DOCUMENTS

| | | | |
|---|---|---|---|
| KR | 10-2015-0077811 | A | 7/2015 |
| TW | 201123134 | A | 7/2011 |
| TW | 201401242 | A | 1/2014 |

* cited by examiner

<LFSR 1>

<LFSR 2>

LFSR (Hex) : FFFF E817 0328 284B 4DE8 ...

DATA (Hex) : FFFF FFFF FFFF FFFF FFFF ...

→ Scramble DATA (Hex) : 0000 17E8 FCD7 D7B4 B217 ...

FIG. 12

LFSR [15:8]

| | | | | | | |
|---|---|---|---|---|---|---|
| LFSR2 (Hex) : | FFFF | E817 | 0328 | 284B | 4DE8 | ... |
| Blank DATA1 (Hex) : | 8'h00 | 8'h00 | 8'h00 | 8'h00 | 8'h00 | ... |
| → Scramble DATA (Hex) : | FF | E8 | 03 | 28 | 4D | ... |

(EPI Tx1)

| | | | | | | |
|---|---|---|---|---|---|---|
| LFSR2 (Hex) : | FFFF | E817 | 0328 | 284B | 4DE8 | ... |
| Blank DATA2 (Hex) : | 8'h22 | 8'h22 | 8'h22 | 8'h22 | 8'h22 | ... |
| → Scramble DATA (Hex) : | DD | CA | 21 | 8A | 6F | ... |

(EPI Tx2)

| | | | | | | |
|---|---|---|---|---|---|---|
| LFSR2 (Hex) : | FFFF | E817 | 0328 | 284B | 4DE8 | ... |
| Blank DATA3 (Hex) : | 8'h44 | 8'h44 | 8'h44 | 8'h44 | 8'h44 | ... |
| → Scramble DATA (Hex) : | BB | AC | 47 | 6C | 09 | ... |

(EPI Tx3)

| | | | | | | |
|---|---|---|---|---|---|---|
| LFSR2 (Hex) : | FFFF | E817 | 0328 | 284B | 4DE8 | ... |
| Blank DATA4 (Hex) : | 8'h88 | 8'h88 | 8'h88 | 8'h88 | 8'h88 | ... |
| → Scramble DATA (Hex) : | 77 | 60 | 8B | AD | C5 | ... |

(EPI Tx4)

FIG. 18

LFSR [15:8]

| | | | | | | |
|---|---|---|---|---|---|---|
| LFSR2_RST2-1 (Hex) : | FFFF | E817 | 0328 | 284B | 4DE8 | ... |
| Blank DATA (Hex) : | 8'h00 | 8'h00 | 8'h00 | 8'h00 | 8'h00 | ... |
| → Scramble DATA (Hex) : | FF | E8 | 03 | 28 | 4D | ... |

(EPI Tx1)

| | | | | | | |
|---|---|---|---|---|---|---|
| LFSR3_RST2-2 (Hex) : | 4425 | 2BA4 | A2A3 | B8D2 | CBF8 | ... |
| Blank DATA (Hex) : | 8'h00 | 8'h00 | 8'h00 | 8'h00 | 8'h00 | ... |
| → Scramble DATA (Hex) : | 44 | 2B | A2 | B8 | CB | ... |

(EPI Tx2)

| | | | | | | |
|---|---|---|---|---|---|---|
| LFSR4_RST2-3 (Hex) : | 5E66 | 6A8E | 86DA | C616 | 0456 | ... |
| Blank DATA (Hex) : | 8'h00 | 8'h00 | 8'h00 | 8'h00 | 8'h00 | ... |
| → Scramble DATA (Hex) : | 5E | 6A | 86 | C6 | 04 | ... |

(EPI Tx3)

| | | | | | | |
|---|---|---|---|---|---|---|
| LFSR5_RST2-4 (Hex) : | 4406 | 08A4 | A5C8 | D37D | 6C1B | ... |
| Blank DATA (Hex) : | 8'h00 | 8'h00 | 8'h00 | 8'h00 | 8'h00 | ... |
| → Scramble DATA (Hex) : | 44 | 08 | A5 | D3 | 6C | ... |

(EPI Tx4)

DATA INTERFACE DEVICE AND METHOD OF DISPLAY APPARATUS

This application claims the benefit of Korean Patent Application No. 10-2020-0097520, filed on Aug. 4, 2020, which is hereby incorporated by reference as if fully set forth herein.

BACKGROUND

Technical Field

The present disclosure relates to a data interface device and method of a display apparatus.

Discussion of the Related Art

In display apparatuses, as a resolution and a size thereof increase, the transfer amount of digital data for displaying an image is increasing. As the transfer amount of data increases, display apparatuses of the related art have a problem where electromagnetic interference (EMI) and power consumption increase.

SUMMARY

Accordingly, embodiments of the present disclosure are directed to a data interface device and a method of display apparatus that substantially obviate one or more of the problems due to limitations and disadvantages of the related art.

To overcome the aforementioned problem of the related art, the present disclosure may provide a data interface device and method of a display apparatus, which decrease EMI and power consumption.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts, as embodied and broadly described herein, a data interface device of a display apparatus comprises a timing controller, encoding clock-embedded image data corresponding to a logic high period of a data enable signal and clock-embedded blank data corresponding to a logic low period of the data enable signal and transferring an encoded data transfer packet to a transfer line, and a source integrated circuit generating an internal clock based on the encoded data transfer packet received through the transfer line and selectively decoding the clock-embedded image data based on the internal clock, wherein a transition pattern of the clock-embedded blank data differs in a plurality of transfer lines.

It is to be understood that both the foregoing general description and the following detailed description are exemplary and explanatory and are intended to provide further explanation of the inventive concepts as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain principles of the disclosure. In the drawings:

FIGS. 11 and 12 are diagrams illustrating an embodiment where a transition pattern of clock-embedded blank data corresponding to each transfer line is differentially designed, in the clock-embedded interface device according to the first embodiment of the present disclosure;

FIGS. 17 and 18 are diagrams illustrating an embodiment where a transition pattern of clock-embedded blank data corresponding to each transfer line is differentially designed, in a clock-embedded interface device according to a third embodiment of the present disclosure.

DETAILED DESCRIPTION

Figure 1:
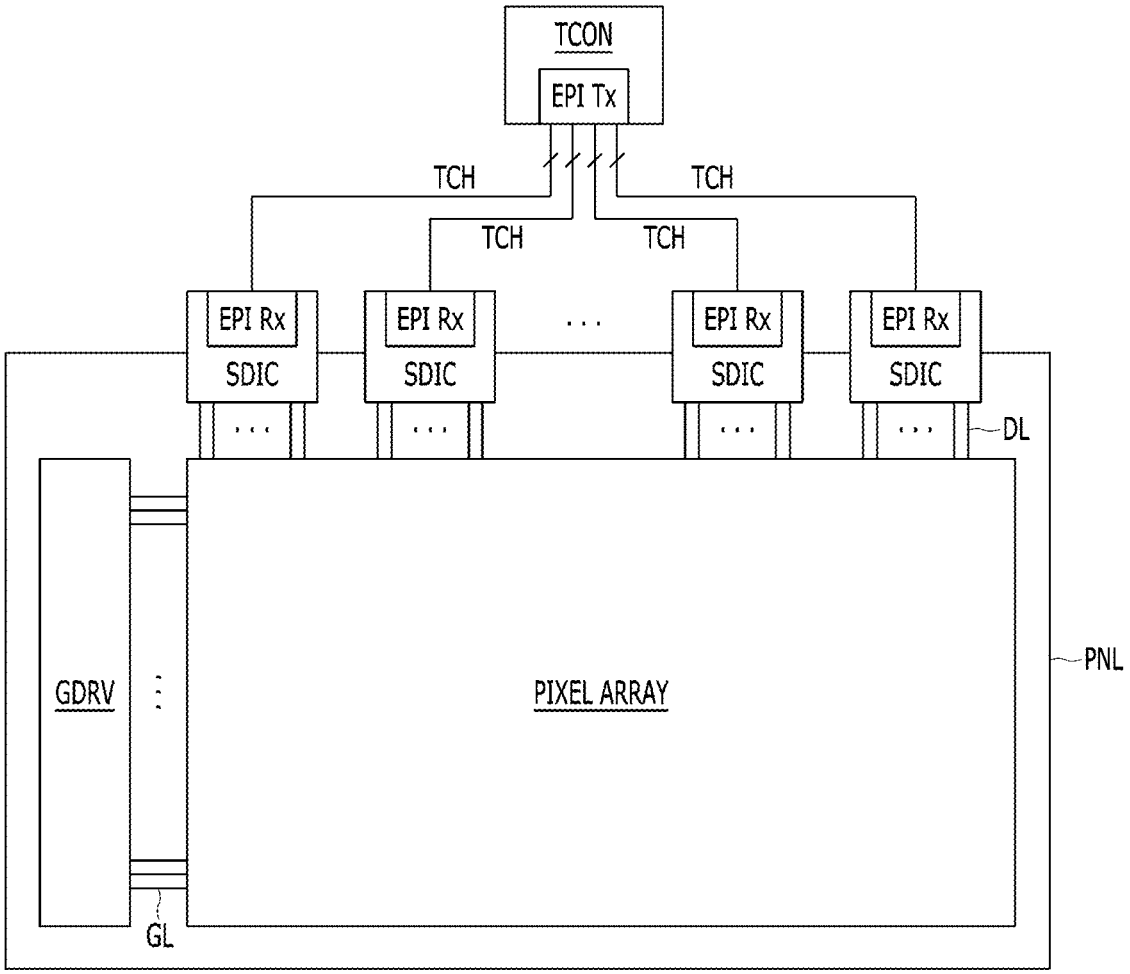
FIG. 1 is a diagram illustrating a display apparatus according to an embodiment of the present disclosure.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Furthermore, the present disclosure is only defined by scopes of claims.

The shapes, sizes, ratios, angles, numbers and the like disclosed in the drawings for description of various embodiments of the present disclosure to describe embodiments of the present disclosure are merely exemplary and the present disclosure is not limited thereto. Like reference numerals refer to like elements throughout. Throughout this specification, the same elements are denoted by the same reference numerals. As used herein, the terms "comprise", "having," "including" and the like suggest that other parts can be added unless the term "only" is used. As used herein, the singular forms "a", "an", and "the" are intended to include the plural forms as well, unless context clearly indicates otherwise.

Elements in various embodiments of the present disclosure are to be interpreted as including margins of error even without explicit statements.

In describing a position relationship, for example, when a position relation between two parts is described as "on~", "over~", "under~", and "next~", one or more other parts may be disposed between the two parts unless "just" or "direct" is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

In the following description, when the detailed description of the relevant known function or configuration is determined to unnecessarily obscure the important point of the present disclosure, the detailed description will be omitted. Hereinafter, embodiments of the present disclosure will be described in detail with reference to the accompanying drawings.

Figure 2:
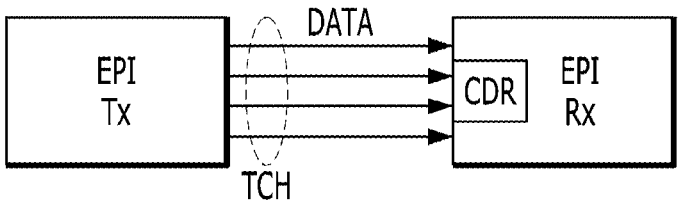
FIGS. 2 and 3 are diagrams for schematically describing a clock-embedded interface device based on a coding scheme according to the present disclosure.
Figure 3:
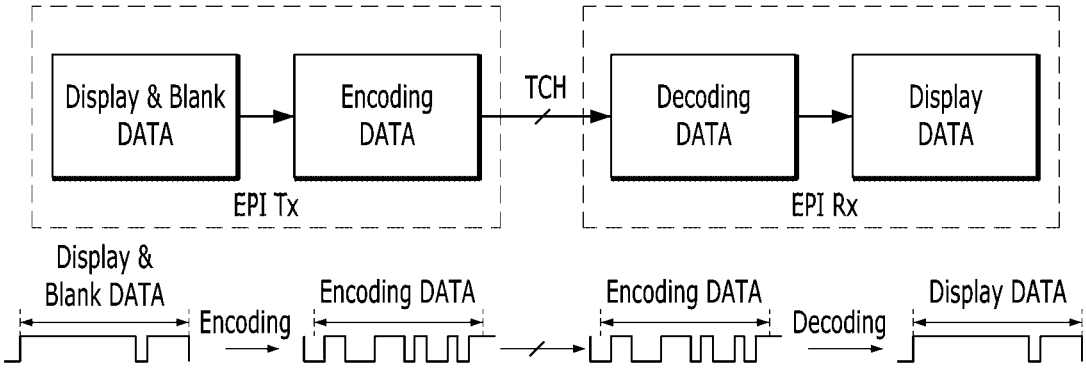

FIG. 1 is a diagram illustrating a display apparatus according to an embodiment of the present disclosure. FIGS. 2 and 3 are diagrams for schematically describing a clock-embedded interface device based on a coding scheme according to the present disclosure.

The inventive concept may be applied to flat panel display apparatuses such as liquid crystal display (LCD) apparatuses, field emission display (FED) apparatuses, plasma display panel (PDP), organic light emitting display apparatuses, and inorganic light emitting display apparatuses, but is not limited thereto. The inventive concept may be applied to bendable display apparatuses, foldable display apparatuses, rollable display apparatuses, flexible display apparatuses, etc. The inventive concept may be applied to various display apparatuses including a timing controller (TCON) and a source driver (SDIC), which are connected to each other through an embedded panel interface (EMI) device. Hereinafter, an organic light emitting display apparatus will be described for example, but the inventive concept is not limited to the organic light emitting display apparatus. Also, the inventive concept is not limited to the terms of elements described in claims. Various terms "circuit" described in claims is not limited to hardware and may denote "logic" performing a corresponding function.

Referring to FIG. 1, the display apparatus according to an embodiment of the present disclosure may include a display panel PNL, a timing controller TCON, a source driver SDIC, a gate driver GDRV, and a data interface device (EPI Tx and EPI Rx).

The display panel PNL may include a pixel array which displays an input image. The pixel array may include a plurality of pixels which are arranged as a matrix type on the basis of an intersection structure of a plurality of data lines DL and a plurality of gate lines GL. Each of the plurality of pixels may include a red (R) subpixel, a green (G) subpixel, and a blue (B) subpixel, for implementing colors, and moreover, may further include a white (W) subpixel.

Each of the subpixels may include a light emitting device, a driving element, a switching element, and a storage element. Internal compensation technology and external compensation technology may be applied for compensating for a driving characteristic deviation between subpixels in association with the light emitting device and/or the driving element. The internal compensation technology may compensate for a driving current flowing in the light emitting device by using a compensation circuit included in each subpixel, regardless of a characteristic variation of the driving element. In the external compensation technology, a sensing circuit disposed outside the display panel PNL may sense a driving characteristic variation of the light emitting device and/or the driving element of each subpixel, and a compensation circuit may correct image data which is to be applied to each subpixel, in order to compensate for the sensed driving characteristic variation.

The pixel array may further include a plurality of touch sensors, for implementing a touch user interface (UI). The touch sensors may each be implemented as a capacitive touch sensor which senses a touch input based on a variation of a capacitance before and after a touch is applied thereto, but are not limited thereto.

The timing controller TCON may receive digital image data and a timing signal, including a vertical synchronization signal, a horizontal synchronization signal, and a data enable signal, from a host system. The timing controller TCON may generate timing control signals for controlling an operation timing of the source driver SDIC and an operation timing of the gate driver GDRV based on the timing signal. The timing control signals may include a source timing control signal for controlling the operation timing of the source driver SDIC and a gate timing control signal for controlling the operation timing of the gate driver GDRV.

The timing controller TCON may be connected to the source driver SDIC through a clock-embedded interface device based on a coding scheme based on a point-to-point scheme and may transfer a data transfer packet including image data to the source driver SDIC. In the clock-embedded interface device, because image data and a clock are included in the data transfer packet and are transferred through one transfer line, a separate clock transfer line may be omitted in a high-resolution and large-size display apparatus and the number of transfer lines may be easily reduced. In the data transfer packet, the clock may not be synchronized with the image data and may have only transition information so as to be recovered by a reception circuit, and thus, a clock-embedded type may be better than a clock-split type in terms of a transfer limitation. A clock-embedded interface device may include a transfer circuit (EPI Tx), a transfer line TCH, and a reception circuit (EPI Rx), the transfer circuit (EPI Tx) may be embedded into the timing controller TCON, and the reception circuit (EPI Rx) may be embedded into the source driver SDIC.

The clock-embedded interface device may be based on a clock bit scheme and a clock coding scheme.

In the clock bit scheme, one data transfer packet may include clock-embedded image data and clock-embedded blank data, in which clock information is reflected. The clock-embedded image data may correspond to a one-line data supply period of one frame, and the clock-embedded blank data may correspond to a horizontal blank period and a vertical blank period of one frame. The clock bit scheme may be a scheme which is not based on a balance between transfer data "1" and "0". Therefore, when the number of data bits including transition in one data transfer packet is small (for example, a case where only one bit is transited into "0" in a data transfer period where "1" is continuously maintained, or a case opposite thereto), the reception circuit may not sense a transition of transfer data, and due to this, recovery data may be distorted. Such a problem may increase when a transfer frequency is higher.

On the other hand, the clock coding scheme may include an encoding scheme and a decoding scheme, which are based on a balance between transfer data "1" and "0". Based on the clock coding scheme, a balance between "1" and "0" may be adjusted through an encoding operation regardless of the kind of transfer data, and thus, transfer data may be stably transferred without being lost. In the clock coding scheme, one data transfer packet may include clock-embedded image data and clock-embedded blank data, where a balance between "1" and "0" is adjusted.

The clock-embedded interface device based on the coding scheme, as illustrated in FIGS. 2 and 3, may include the transfer circuit (EPI Tx) and the reception circuit (EPI Rx) which are connected to each other through a plurality of transfer lines TCH. The transfer circuit (EPI Tx) may encode the clock-embedded image data and the clock-embedded blank data, which are obtained through scrambling, and may transfer an encoded data transfer packet to the reception circuit (EPI Rx) through the plurality of transfer lines TCH. The clock-embedded blank data may include a clock training pattern (CTP) corresponding to a blank period. The reception circuit (EPI Rx) may include a clock and data recovery (CDR) circuit for recovering clock information from the data transfer packet. The CDR circuit may receive the data transfer packet through the transfer line TCH and may track a transition pattern of the data transfer packet to recover clock information included in the data transfer packet. The reception circuit (EPI Rx) may decode a data transfer packet based on clock information recovered by the CDR circuit and may descramble decoded data to recover image data.

In the encoded data transfer packet, the clock-embedded image data may be transferred in a one-line data supply period of one frame, and the clock-embedded blank data may be transferred in a horizontal blank period and a vertical blank period of one frame. Because the clock-embedded image data should be recovered to image data through a decoding operation and a descrambling operation in the reception circuit (EPI Rx), a scrambling operation of the transfer circuit (EPI Tx) and a descrambling operation of the reception circuit (EPI Rx) performed on the clock-embedded image data should be predefined to have correlation therebetween. For example, the scrambling operation and the descrambling operation performed on the clock-embedded image data may be performed based on an output of the same linear feedback shifter register.

On the other hand, in an encoded data transfer packet, the clock-embedded blank data may be needed for a tracking operation of the CDR circuit (i.e., a tracking operation performed on a transition pattern) and may be irrelevant to image data, and thus, may not be recovered by the reception circuit (EPI Rx). That is, the clock-embedded blank data may be encoded after being scrambled by the transfer circuit (EPI Tx), but may not be descrambled and decoded by the reception circuit (EPI Rx). Accordingly, a scrambling operation of the transfer circuit (EPI Tx) performed on the clock-embedded blank data may not be defined to correlate with a descrambling operation of the reception circuit (EPI Rx), and thus, the convenience of design may be ensured.

The clock-embedded blank data corresponding to the transfer lines TCH may be scrambled to have various types of transition patterns in the transfer circuit (EPI Tx). When the clock-embedded blank data is transferred as a fixed type transition pattern, noise of a specific frequency component may repeatedly occur, and due to this, EMI and power consumption may increase. On the other hand, when the clock-embedded blank data is transferred to have a different transition pattern for each transfer line TCH, the problem may be easily solved. To this end, embodiments of a data interface device which operates so that pieces of clock-embedded blank data are transferred through at least two transfer lines to have different transition patterns will be described below with reference to FIGS. 6 to 20.

A one data transfer packet transferred to the reception circuit (EPI Rx) by the transfer circuit (EPI Tx) in a vertical blank period of one frame may further include Rx control data. The Rx control data may include a gate timing control signal for controlling the operation timing of the gate driver GDRV and a source timing control signal for controlling the operation timing of the source driver SDIC. The gate timing control signal and the source timing control signal may be recovered by the reception circuit (EPI Rx).

The source driver SDIC may include the reception circuit (EPI Rx) and a digital-to-analog converter. The reception circuit (EPI Rx) may supply recovered digital image data and a recovered source timing control signal to the digital-to-analog converter in synchronization with a clock. The digital-to-analog converter may convert digital image data into a gamma compensation voltage (i.e., a data voltage) based on the source timing control signal, and then, may output the gamma compensation voltage to the date lines DL. Data voltages output to the data lines DL may be applied to subpixels in synchronization with a scan signal supplied through the gate lines GL. The source driver SDIC may supply the gate timing control signal, recovered by the reception circuit (EPI Rx), to the gate driver GDRV through a separate signal line.

The gate driver GDRV may generate the scan signal which swings between a gate-on voltage and a gate-off voltage, based on the gate timing control signal. The gate-on voltage may be a voltage for turning on a switching element of each subpixel, and the gate-off voltage may be a voltage for turning off the switching element of each subpixel. The gate driver GDRV may sequentially or non-sequentially output the scan signal to the gate lines GL to select subpixels, into which data voltages are to be charged, by line units.

Figure 4:
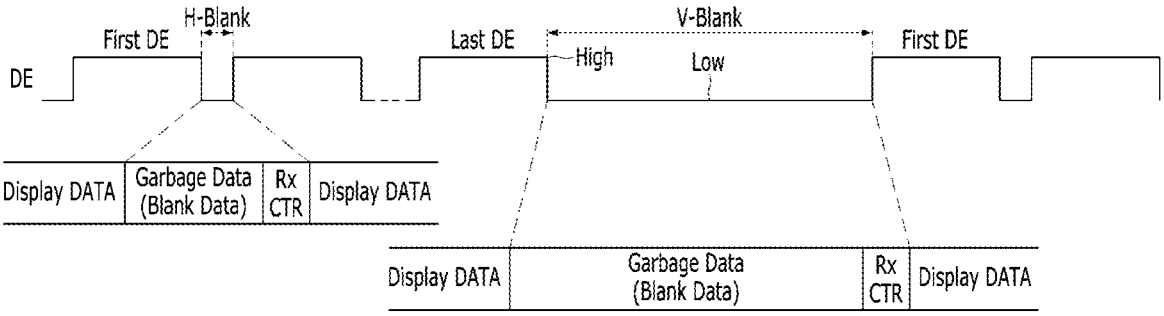
FIG. 4 is a diagram illustrating clock-embedded image data and clock-embedded blank data constituting a data transfer packet in a clock-embedded interface device according to the present disclosure.

FIG. 4 is a diagram illustrating clock-embedded image data and clock-embedded blank data constituting a data transfer packet in a clock-embedded interface device according to the present disclosure.

Referring to FIG. 4, a data transfer packet may be encoded by the transfer circuit (EPI Tx) based on a data enable signal DE. The transfer circuit (EPI Tx) may encode clock-embedded image data to correspond to a logic high period of the data enable signal DE and may encode clock-embedded blank data to correspond to a logic low period of the data enable signal DE. The transfer circuit (EPI Tx) may further encode Rx control data (Rx CTR) to correspond to the logic low period of the data enable signal DE.

The logic high period of the data enable signal DE may correspond to a one-line data supply period of one frame. The one-line data supply period may have a number of data enable signals (First DE to Last DE) equal to a vertical resolution of the display panel. The logic low period of the data enable signal DE may correspond to a horizontal blank period and a vertical blank period of one frame. The horizontal blank period and the vertical blank period may each be defined as a time when the clock-embedded image data is not transferred in one frame. It may be designed that pieces of clock-embedded blank data transferred in the horizontal blank period and the vertical blank period have different transition patterns for each transfer line, and thus, EMI and power consumption occurring in transfer lines may be reduced.

Figure 5A:
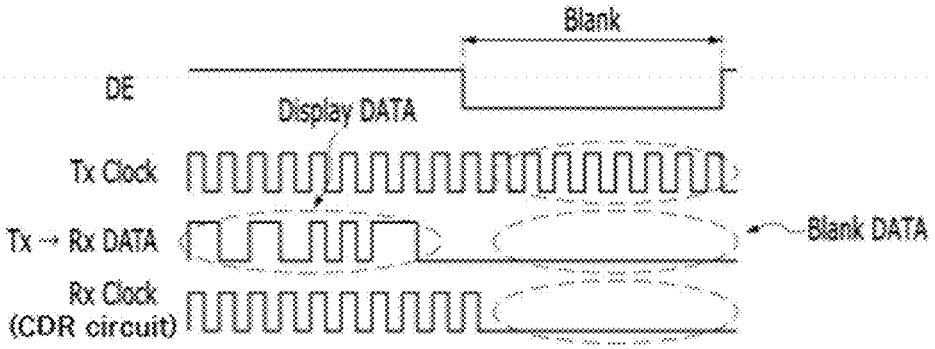
FIGS. 5A and 5B are diagrams for describing the reason that clock-embedded blank data including transition should be transferred in a vertical or horizontal blank period of FIG. 4.
Figure 5B:
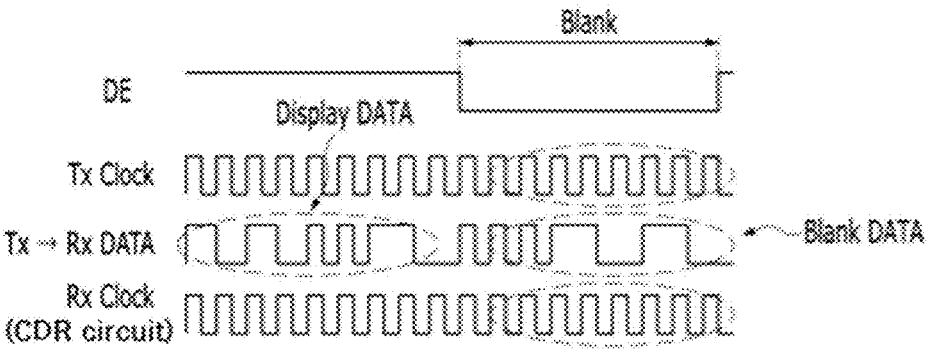

FIGS. 5A and 5B are diagrams for describing the reason that clock-embedded blank data including transition should be transferred in a vertical or horizontal blank period of FIG. 4.

In a blank period, the clock-embedded interface device may not transfer clock-embedded image data and may transfer clock-embedded blank data. The clock-embedded blank data should be transferred to have transition which enables a reception circuit of a source driver to check/generate/track clock information during the blank period.

For example, as in FIG. 5A, in a case where the clock-embedded blank data is transfer without including transition (for example, a case where all transfer data of the blank period are "0" or "1"), a CDR circuit included in the reception circuit may not recover a transfer clock (Tx Clock) and clock information between a transfer circuit and the reception circuit may not be checked, and thus, it may be unable to perform normal communication.

In order to check the clock information between the transfer circuit and the reception circuit, as in FIG. 5B, clock-embedded blank data transferred during the blank period should include transition which is higher than or equal to a certain level. The clock-embedded blank data may be defined as garbage data because transition needed for a clock tracking operation in the CDR circuit is needed but data is not needed.

[First Embodiment]

Figure 6:
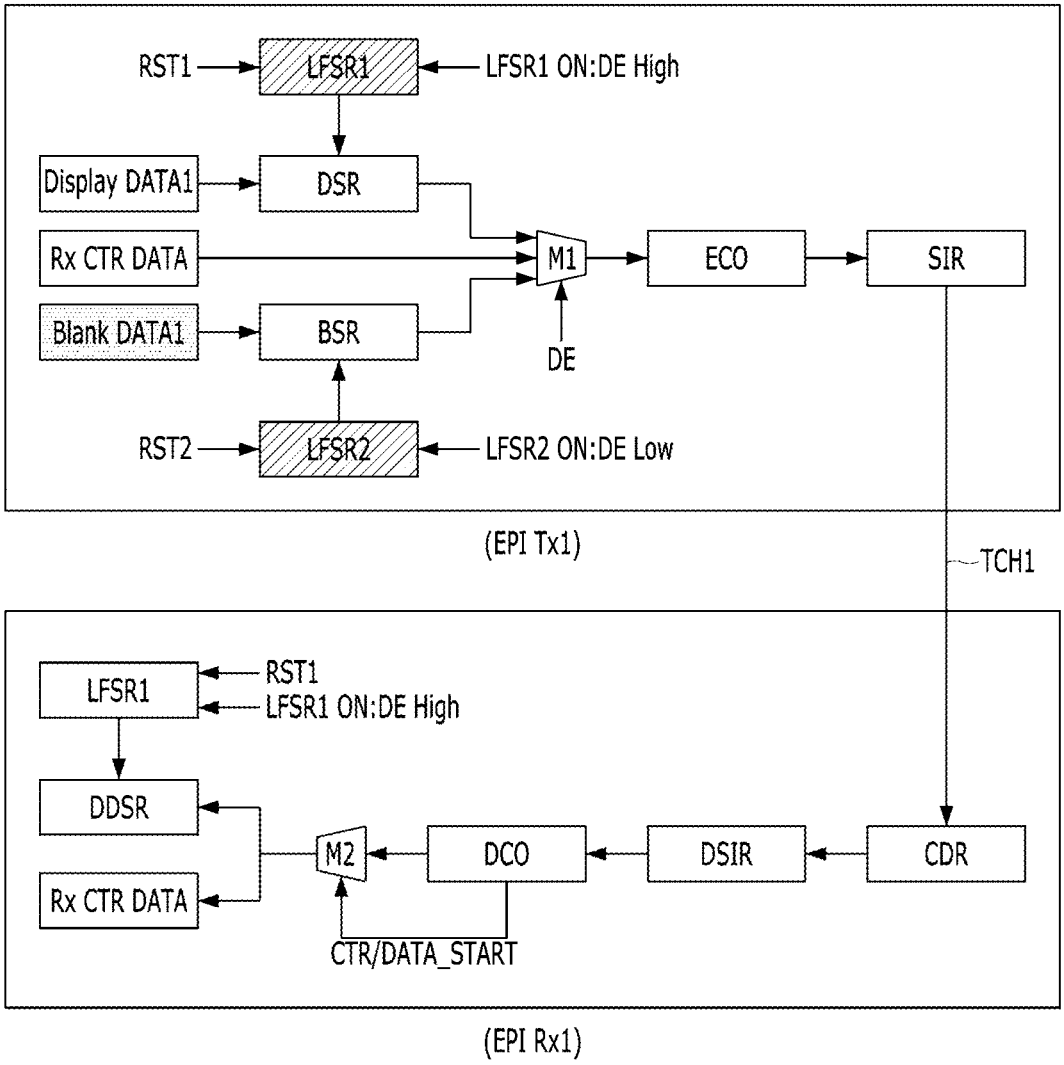
FIGS. 6 and 7 are diagrams illustrating a first embodiment where a transition pattern of clock-embedded blank data is differently implemented in transfer lines, in a clock-embedded interface device according to the present disclosure.
Figure 7:
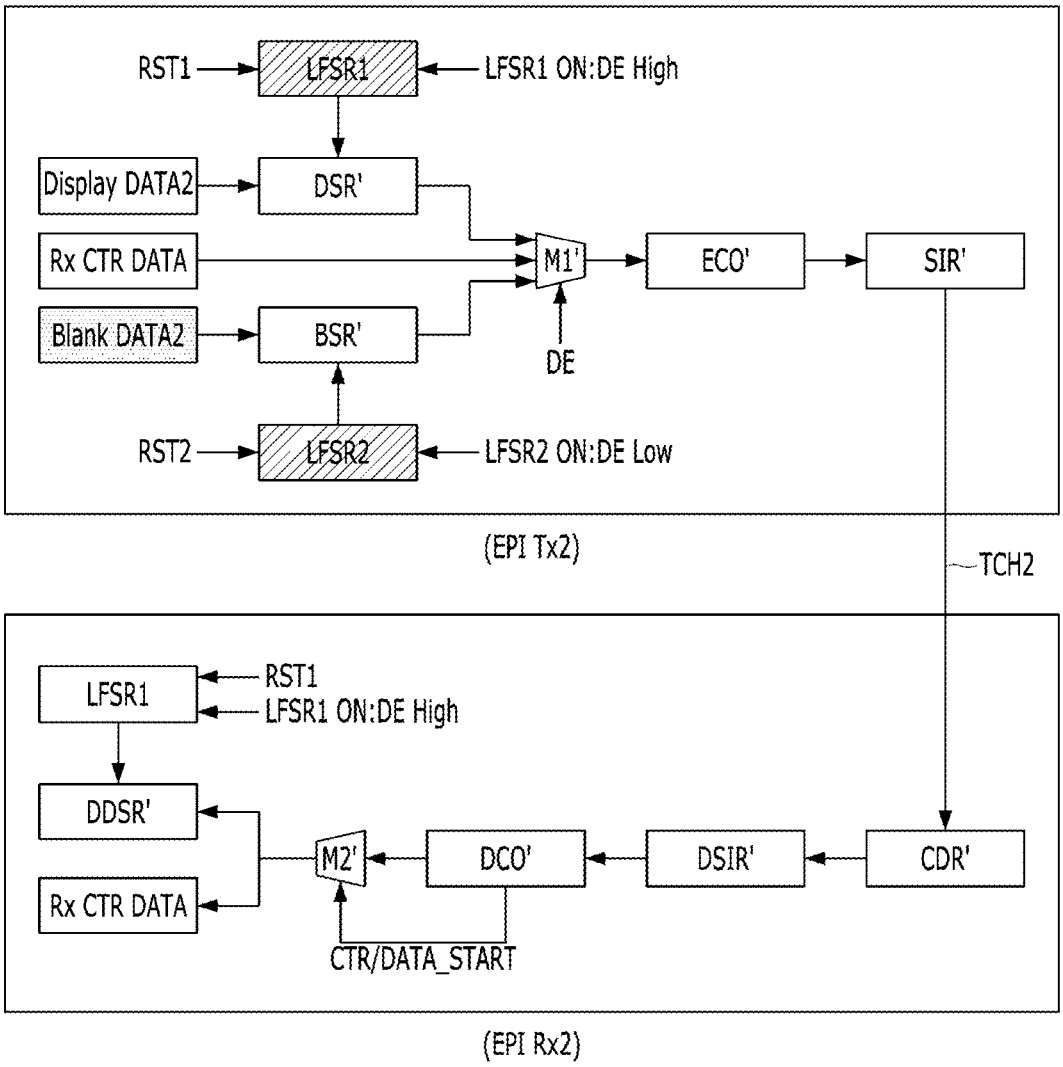
Figure 8:
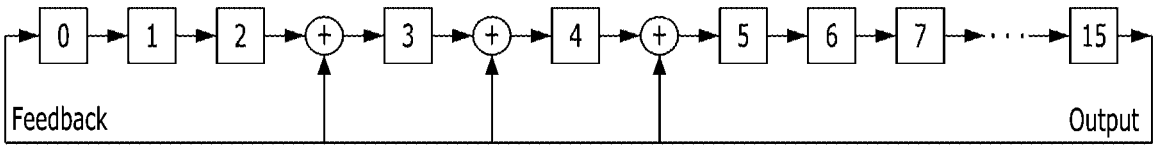
FIGS. 8 and 9 are diagrams illustrating an embodiment where a first linear feedback shifter register for generating and recovering clock-embedded image data and a second linear feedback shifter register for generating clock-embedded blank data are differently configured, in a clock-embedded interface device according to a first embodiment of the present disclosure.
Figure 9:
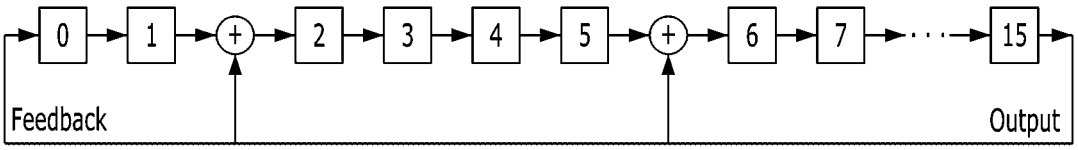
Figure 10:
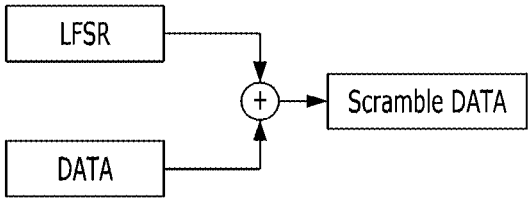
FIG. 10 is a diagram illustrating an example which generates clock-embedded image data or clock-embedded blank data, in the clock-embedded interface device according to the first embodiment of the present disclosure.

FIGS. 6 and 7 are diagrams illustrating a first embodiment where a transition pattern of clock-embedded blank data is differently implemented in transfer lines, in a clock-embedded interface device according to the present disclosure. FIGS. 8 and 9 are diagrams illustrating an embodiment where a first linear feedback shifter register for generating and recovering clock-embedded image data and a second linear feedback shifter register for generating clock-embedded blank data are differently configured, in a clock-embedded interface device according to a first embodiment of the present disclosure. FIG. 10 is a diagram illustrating an example which generates clock-embedded image data or clock-embedded blank data, in the clock-embedded interface device according to the first embodiment of the present disclosure.

Referring to FIGS. 6 and 7, the clock-embedded interface device according to the first embodiment may include a first transfer circuit (EPI Tx1) and a first reception circuit (EPI Rx1), which are connected to each other through a first transfer line TCH1, and a second transfer circuit (EPI Tx2) and a second reception circuit (EPI Rx2) which are connected to each other through a second transfer line TCH2.

Referring to FIG. 6, the first transfer circuit (EPI Tx1) may encode first clock-embedded image data corresponding to a logic high period of a data enable signal DE and first clock-embedded blank data corresponding to a logic low period of the data enable signal DE and may transfer an encoded first data transfer packet to the first transfer line TCH1.

Referring to FIG. 6, the first transfer circuit (EPI Tx1) may include a first linear feedback shifter register LFSR1, a first image scramble circuit DSR, a second linear feedback shifter register LFSR2, a first blank scramble circuit BSR, a first multiplexer M1, a first encoding circuit ECO, and a first serialization circuit SIR.

The first linear feedback shifter register LFSR1 may output first linear feedback information based on a first seed signal RST1 in the logic high period of the data enable signal DE. The first linear feedback shifter register LFSR1 may have a structure where a value input to a register is calculated as a linear function of previous state values. In this case, a linear function used may mainly be an XOR operation. The first seed signal RST1 may denote an initial bit value which is input to the first linear feedback shifter register LFSR1. Because an operation of the first linear feedback shifter register LFSR1 is deterministic, an output progression of first linear feedback information may be determined based on a previous value. Also, because the number of values of the first linear feedback shifter register LFSR1 is finite, the output progression may be repeated at a specific period. The first linear feedback shifter register LFSR1, for example, may be implemented as in FIG. 8. The first linear feedback shifter register LFSR1 of FIG. 8 may include a polynomial structure such as "$X^{16}+X^6+X^2+1$".

The first image scramble circuit DSR may combine and scramble first image data (Display DATA1) and the first linear feedback information to generate first clock-embedded image data. The first image scramble circuit DSR may generate scramble data based on a method illustrated in FIG. 10 and may output the scramble data as the first clock-embedded image data.

The second linear feedback shifter register LFSR2 may output second linear feedback information based on a second seed signal RST2 differing from the first seed signal RST1 in the logic low period of the data enable signal DE. The second linear feedback shifter register LFSR2 may have a structure where a value input to a register is calculated as a linear function of previous state values. In this case, the linear function may mainly be an XOR operation. The second seed signal RST2 may denote an initial bit value which is input to the second linear feedback shifter register LFSR2. Because an operation of the second linear feedback shifter register LFSR2 is deterministic, an output progression of second linear feedback information may be determined based on a previous value. Also, because the number of values of the second linear feedback shifter register LFSR2 is finite, the output progression may be repeated at a specific period. The second linear feedback shifter register LFSR2, for example, may be implemented as in FIG. 9. The second linear feedback shifter register LFSR2 of FIG. 9 may include a polynomial structure such as "$X^{16}+X^5+X^4+X^3+1$".

The first blank scramble circuit BSR may combine and scramble first blank data (Blank DATA1) and the second linear feedback information to generate first clock-embedded blank data. The first blank scramble circuit BSR may generate scramble data based on the method illustrated in FIG. and may output the scramble data as the first clock-embedded blank data.

The first multiplexer M1 may select the first clock-embedded image data to correspond to the logic high period of the data enable signal DE and may select the first clock-embedded blank data and the Rx control data to correspond to the logic low period of the data enable signal DE, and the first multiplexer M1 may output the selected first clock-embedded image data and the selected first clock-embedded blank data and Rx control data.

The first encoding circuit ECO may encode the first clock-embedded image data mapped to the logic high period of the data enable signal DE and the first clock-embedded blank data and the Rx control data mapped to the logic low period of the data enable signal DE to generate a first data transfer packet. An encoded first data transfer packet may be implemented in a parallel structure of a color subpixel unit (for example, an R, G, and B unit or an RGBW unit).

The first serialization circuit SIR may convert the first data transfer packet, obtained through encoding by the first encoding circuit ECO, into a serial form suitable for transfer and may output a converted first data transfer packet to the first transfer line TCH1.

Referring to FIG. 6, the first reception circuit (EPI Rx1) may generate a first internal clock based on the first data transfer packet received through the first transfer line TCH1, decode the first clock-embedded blank data and the Rx control data based on the first internal clock, and descramble decoded first clock-embedded blank data and the Rx control data to recover the first image data (Display DATA1).

Referring to FIG. 6, the first reception circuit (EPI Rx1) may include a CDR circuit, a first parallelization circuit DSIR, a first decoding circuit DCO, a second multiplexer M2, a first linear feedback shifter register LFSR1, and a first image descramble circuit DDSR.

The CDR circuit may generate a first internal clock based on transition information about the first data transfer packet. The CDR circuit may generate and output the first internal clock by using a phase locked loop (PLL) or a delay locked loop (DLL).

The first parallelization circuit DSIR may convert the first data transfer packet having a serial structure into a parallel structure of an R, W, G, and B unit based on a timing of the first internal clock.

The first decoding circuit DCO may decode a converted first data transfer packet having a parallel structure and may extract start information about the Rx control data and start information about the first clock-embedded image data from the first data transfer packet.

The second multiplexer M2 may select the Rx control data from the first data transfer packet based on the start information about the Rx control data to output the selected Rx control data and may select the first clock-embedded image data from the first data transfer packet based on the start information about the first clock-embedded image data to output the selected first clock-embedded image data.

The first reception circuit (EPI Rx1) and the first transfer circuit (EPI Tx1) may share the same first linear feedback shifter register LFSR1 so that the first image data (Display DATA1) is accurately recovered. That is, the first linear feedback shifter register LFSR1 of the first reception circuit (EPI Rx1) may have the same structure as that of the first linear feedback shifter register LFSR1 of the first transfer circuit (EPI Tx1). The first linear feedback shifter register LFSR1 may output first linear feedback information.

The first image descramble circuit DDSR may recover the first image data (Display DATA1) so that the first linear feedback information is descrambled from the first clock-embedded image data.

Referring to FIG. 7, the second transfer circuit (EPI Tx2) may encode the second clock-embedded image data corresponding to the logic high period of the data enable signal DE and the second clock-embedded blank data corresponding to the logic low period of the data enable signal DE and may transfer an encoded second data transfer packet to the second transfer line TCH2.

Referring to FIG. 7, the second transfer circuit (EPI Tx2) may include the first linear feedback shifter register LFSR1, a second image scramble circuit DSR', the second linear feedback shifter register LFSR2, a second blank scramble circuit BSR', a third multiplexer M1', a second encoding circuit ECO', and a second serialization circuit SIR'.

The first linear feedback shifter register LFSR1 may be the same as that of the first transfer circuit (EPI Tx1). The first transfer circuit (EPI Tx1) and the second transfer circuit (EPI Tx2) may share the first linear feedback shifter register LFSR1, and thus, the convenience of design may increase.

The second image scramble circuit DSR' may combine and scramble second image data (Display DATA2) and the first linear feedback information to generate second clock-embedded image data. The second image scramble circuit DSR' may generate scramble data based on the method illustrated in FIG. 10 and may output the scramble data as the second clock-embedded image data.

The second linear feedback shifter register LFSR2 may be the same as that of the first transfer circuit (EPI Tx1). The first transfer circuit (EPI Tx1) and the second transfer circuit (EPI Tx2) may share the second linear feedback shifter register LFSR2, and thus, the convenience of design may increase.

The second blank scramble circuit BSR' may combine and scramble second blank data (Blank DATA2) and the second linear feedback information to generate second clock-embedded blank data. The second blank scramble circuit BSR' may generate scramble data based on the method illustrated in FIG. 10 and may output the scramble data as the second clock-embedded blank data.

The second blank data (Blank DATA2) may be designed to differ from the first blank data (Blank DATA1) of the first transfer circuit (EPI Tx1). When the first blank data (Blank DATA1) and the second blank data (Blank DATA2) are differently designed, the first transfer circuit (EPI Tx1) and the second transfer circuit (EPI Tx2) may share the same second linear feedback shifter register LFSR2, but a first transition pattern of the first clock-embedded blank data and a second transition pattern of the second clock-embedded blank data may be differently generated. This will be additionally described with reference to FIGS. 11 and 12.

The third multiplexer M1' may select the second clock-embedded image data to correspond to the logic high period of the data enable signal DE and may select the second clock-embedded blank data and the Rx control data to correspond to the logic low period of the data enable signal DE, and the third multiplexer M1' may output the selected second clock-embedded image data and the selected second clock-embedded blank data and Rx control data.

The second encoding circuit ECO' may encode the second clock-embedded image data mapped to the logic high period of the data enable signal DE and the second clock-embedded blank data and the Rx control data mapped to the logic low period of the data enable signal DE to generate a second data transfer packet. An encoded second data transfer packet may be implemented in a parallel structure of an R, W, G, and B unit.

The second serialization circuit SIR' may convert the second data transfer packet, obtained through encoding by the second encoding circuit ECO', into a serial form suitable for transfer and may output a converted second data transfer packet to the second transfer line TCH2.

Referring to FIG. 7, the second reception circuit (EPI Rx2) may generate a second internal clock based on the second data transfer packet received through the second transfer line TCH2, decode the second clock-embedded image data and the Rx control data based on the second internal clock, and descramble decoded second clock-embedded image data and the Rx control data to recover the second image data (Display DATA2).

Referring to FIG. 7, the second reception circuit (EPI Rx2) may include a CDR' circuit, a second parallelization circuit DSIR', a second decoding circuit DCO', a fourth multiplexer M2', a first linear feedback shifter register LFSR1, and a second image descramble circuit DDSR'.

The CDR' circuit may generate a second internal clock based on transition information about the second data transfer packet. The CDR' circuit may generate and output the second internal clock by using a PLL or a DLL.

The second parallelization circuit DSIR' may convert the second data transfer packet having a serial structure into a parallel structure of an R, W, G, and B unit based on a timing of the second internal clock.

The second decoding circuit DCO' may decode a converted second data transfer packet having a parallel structure and may extract start information about the Rx control data and start information about the second clock-embedded image data from the second data transfer packet.

The fourth multiplexer M2' may select the Rx control data from the second data transfer packet based on the start information about the Rx control data to output the selected Rx control data and may select the second clock-embedded image data from the second data transfer packet based on the start information about the second clock-embedded image data to output the selected second clock-embedded image data.

The second reception circuit (EPI Rx2) and the second transfer circuit (EPI Tx2) may share the same first linear feedback shifter register LFSR1 so that the second image data (Display DATA2) is accurately recovered. That is, the first linear feedback shifter register LFSR1 of the second reception circuit (EPI Rx2) may have the same structure as that of the first linear feedback shifter register LFSR1 of the second transfer circuit (EPI Tx2). The first linear feedback shifter register LFSR1 may output first linear feedback information.

The second image descramble circuit DDSR' may recover the second image data (Display DATA2) so that the first linear feedback information is descrambled from the second clock-embedded image data.

Figure 11:
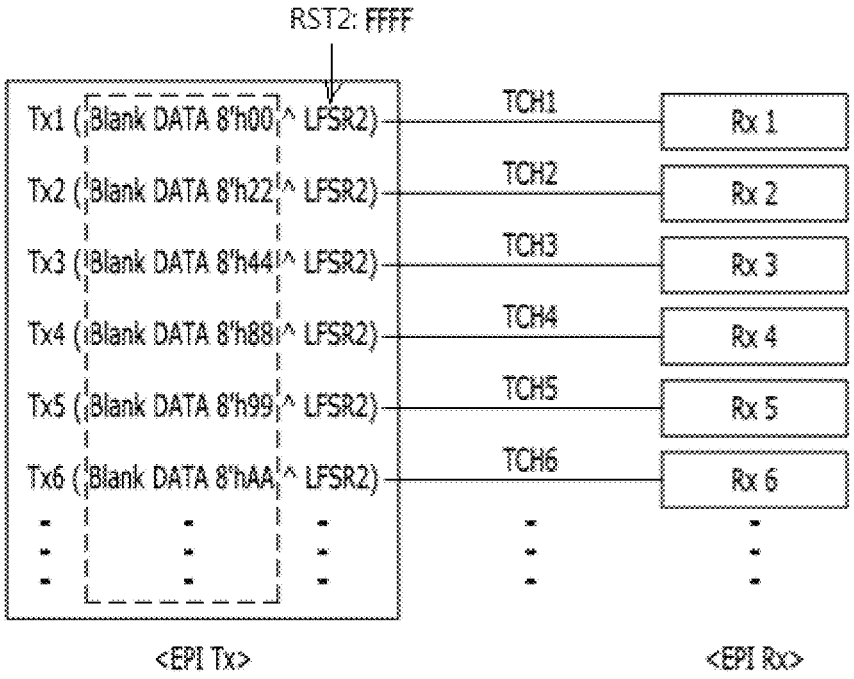

FIGS. 11 and 12 are diagrams illustrating an embodiment where a transition pattern of clock-embedded blank data corresponding to each transfer line is differentially designed, in the clock-embedded interface device according to the first embodiment of the present disclosure.

Referring to FIGS. 11 and 12, first to sixth transfer circuits (EPI Tx1 to EPI Tx6) respectively connected to first to sixth transfer lines TCH1 to TCH6 may share the same second linear feedback shifter register LFSR2, and thus, the convenience of design may increase. However, sizes of pieces of blank data which are to be applied to the first to sixth transfer circuits (EPI Tx1 to EPI Tx6) may be differently designed so that a transition pattern of clock-embedded blank data, included in each of first to sixth data transfer packets which are to be transferred through the first to sixth transfer lines TCH1 to TCH6, is changed for each data transfer packet. For example, sizes of the pieces of blank data which are to be applied to the first to sixth transfer circuits (EPI Tx1 to EPI Tx6) may be differentially designed to 8'h00, 8'h22, 8'h44, 8'h88, 8'h99, and 8'hAA. Here, "8'h" may denote 8 bits, and "00", "22", "44", "88", "99", and "AA" may each denote a hexadecimal number having 8 bits. For example, a hexadecimal number "99" may be expressed as "10011001", and "AA" may be expressed as "10101010".

As in FIG. 12, in a case where it is assumed that second linear feedback information which is an output of the second linear feedback shifter register LFSR2 applied to the first to fourth transfer circuits (EPI Tx1 to EPI Tx4) in common is implemented as a hexadecimal number having 16 bits "FFFF, E817, 0328, 284B, 4DE8 . . . ", when sizes of first to fourth blank data respectively applied to the first to fourth transfer circuits (EPI Tx1 to EPI Tx4) are 8'h00, 8'h22, 8'h44, and 8'h88 and differ, an upper 8 bit combination result [15, 8] between the second linear feedback information and blank data may differ in the first to fourth transfer circuits (EPI Tx1 to EPI Tx4). In other words, scramble data (i.e., transition patterns of first to fourth clock-embedded blank data) in the first to fourth transfer circuits (EPI Tx1 to EPI Tx4) may differ in the first to fourth transfer circuits (EPI Tx1 to EPI Tx4). In FIG. 12, a first output "FFFF" of the second linear feedback shifter register LFSR2 may be the second seed signal RST2 described above.

[Second Embodiment]

Figure 13:
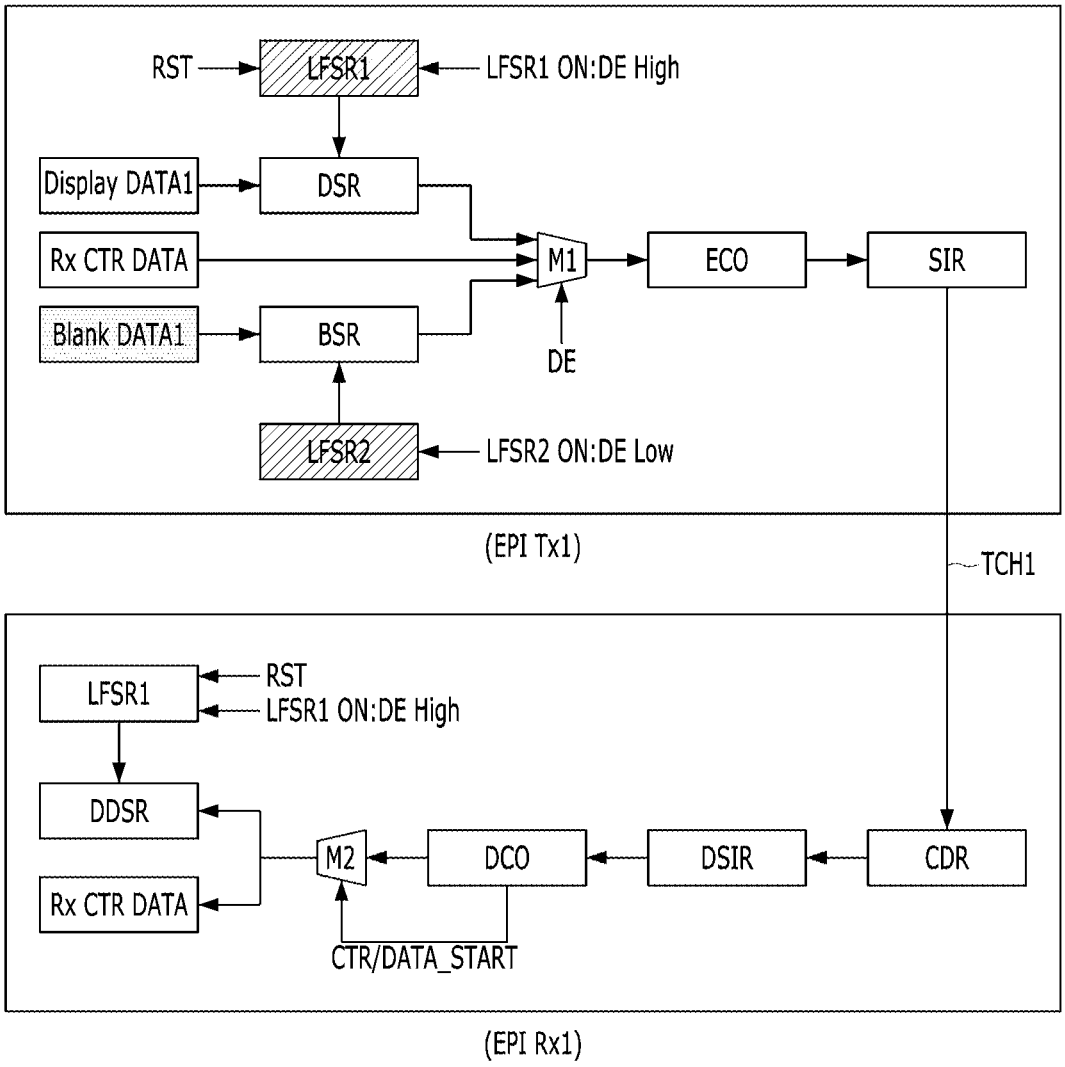
FIGS. 13 and 14 are diagrams illustrating a second embodiment where a transition pattern of clock-embedded blank data is differently implemented in transfer lines, in a clock-embedded interface device according to the present disclosure.
Figure 14:
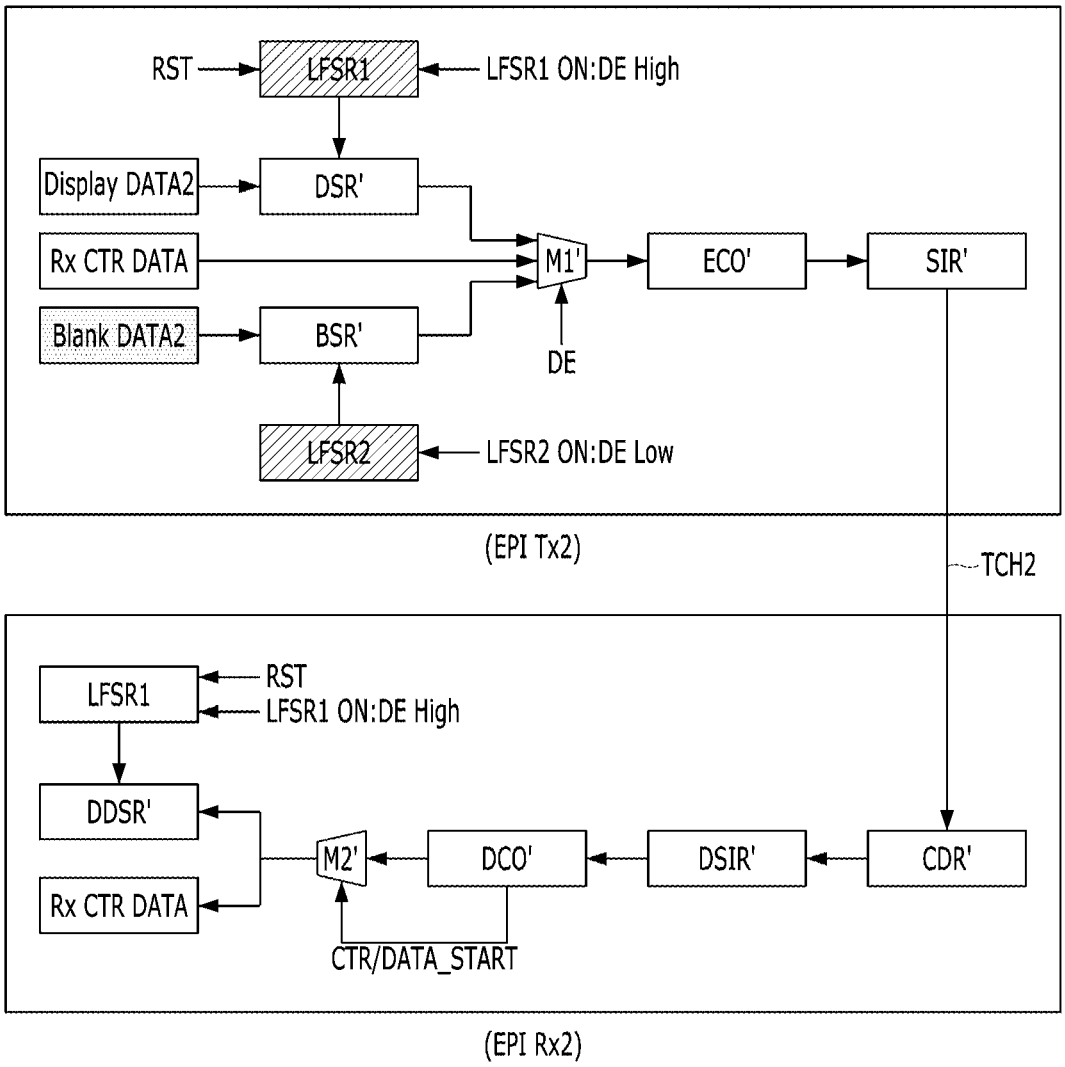

FIGS. 13 and 14 are diagrams illustrating a second embodiment where a transition pattern of clock-embedded blank data is differently implemented in transfer lines, in a clock-embedded interface device according to the present disclosure.

Referring to FIGS. 13 and 14, the clock-embedded interface device according to the second embodiment may include a first transfer circuit (EPI Tx1) and a first reception circuit (EPI Rx1), which are connected to each other through a first transfer line TCH1, and a second transfer circuit (EPI Tx2) and a second reception circuit (EPI Rx2) which are connected to each other through a second transfer line TCH2.

Referring to FIG. 13, the first transfer circuit (EPI Tx1) may encode first clock-embedded image data corresponding to a logic high period of a data enable signal DE and first clock-embedded blank data corresponding to a logic low period of the data enable signal DE and may transfer an encoded first data transfer packet to the first transfer line TCH1.

Referring to FIG. 13, the first transfer circuit (EPI Tx1) may include a first linear feedback shifter register LFSR1, a first image scramble circuit DSR, a second linear feedback shifter register LFSR2, a first blank scramble circuit BSR, a first multiplexer M1, a first encoding circuit ECO, and a first serialization circuit SIR.

Comparing with FIG. 6, the first transfer circuit (EPI Tx1) of FIG. 13 may have a difference in that the second linear feedback shifter register LFSR2 outputs second linear feedback information without a designated seed signal. Because the second linear feedback shifter register LFSR2 of FIG. 13 outputs the second linear feedback information without the designated seed signal, a period at which the same value of the second linear feedback information is repeated may extend compared to FIG. 6. In the first transfer circuit (EPI Tx1) of FIG. 13, a transition pattern of clock-embedded blank data may be differentially designed more easily than FIG. 6.

In the first transfer circuit (EPI Tx1) of FIG. 13, the elements other than the second linear feedback shifter register LFSR2 may be substantially the same as corresponding elements of FIG. 6. Also, the first reception circuit (EPI Rx1) of FIG. 13 may be substantially the same as the first reception circuit (EPI Rx1) of FIG. 6.

Referring to FIG. 14, the second transfer circuit (EPI Tx2) may encode the second clock-embedded image data corresponding to the logic high period of the data enable signal DE and the second clock-embedded blank data corresponding to the logic low period of the data enable signal DE and may transfer an encoded second data transfer packet to the second transfer line TCH2.

Referring to FIG. 14, the second transfer circuit (EPI Tx2) may include the first linear feedback shifter register LFSR1, a second image scramble circuit DSR', the second linear feedback shifter register LFSR2, a second blank scramble circuit BSR', a third multiplexer M1', a second encoding circuit ECO', and a second serialization circuit SIR'.

Comparing with FIG. 7, the second transfer circuit (EPI Tx2) of FIG. 14 may have a difference in that the second linear feedback shifter register LFSR2 outputs second linear feedback information without a designated seed signal. Because the second linear feedback shifter register LFSR2 of FIG. 14 outputs the second linear feedback information without the designated seed signal, a period at which the same value of the second linear feedback information is repeated may extend compared to FIG. 7. In the second transfer circuit (EPI Tx2) of FIG. 14, a transition pattern of clock-embedded blank data may be differentially designed more easily than FIG. 7.

In the second transfer circuit (EPI Tx2) of FIG. 14, the elements other than the second linear feedback shifter register LFSR2 may be substantially the same as corresponding elements of FIG. 7. Also, the second reception circuit (EPI Rx2) of FIG. 14 may be substantially the same as the second reception circuit (EPI Rx2) of FIG. 7.

[Third Embodiment]

Figure 15:
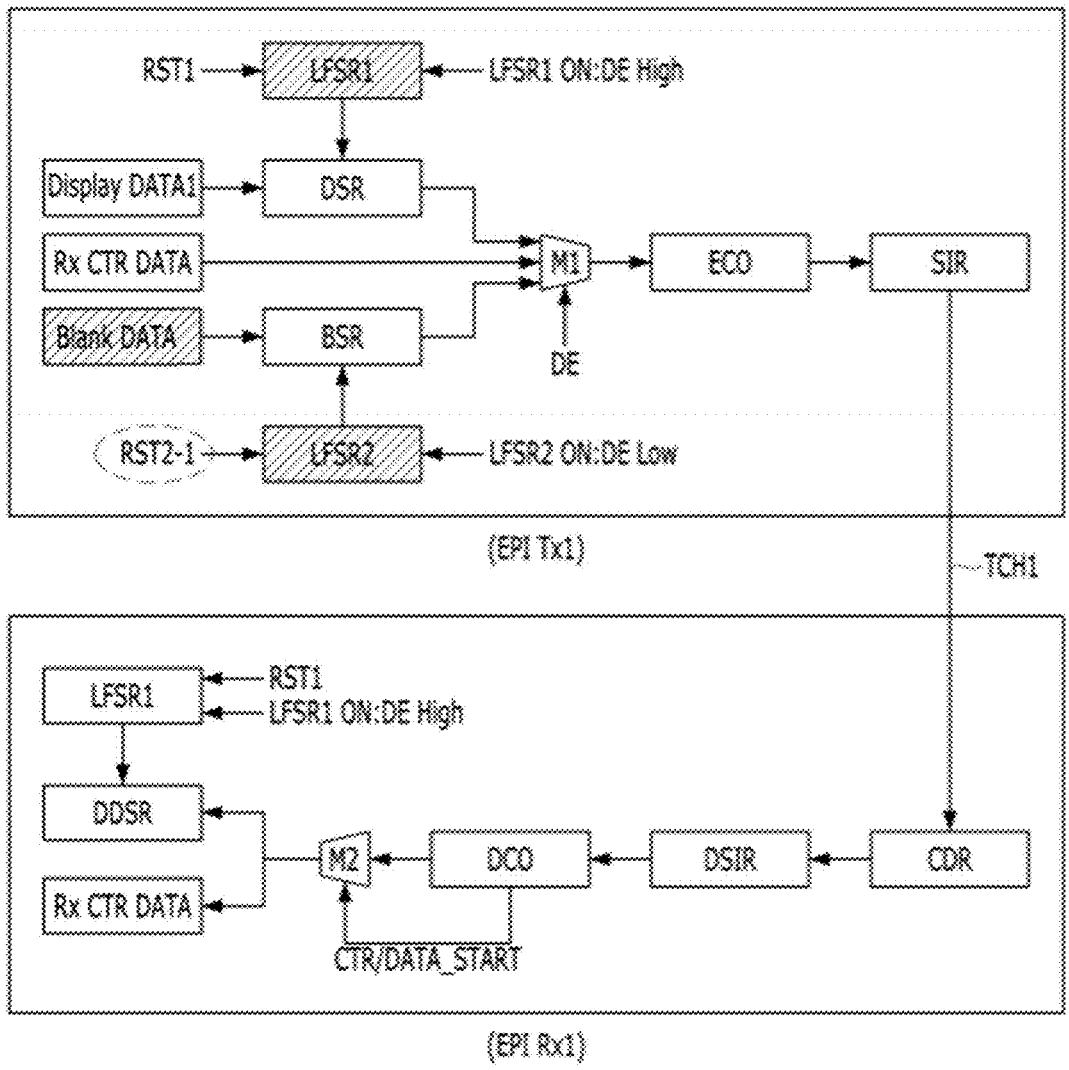
FIGS. 15 and 16 are diagrams illustrating a third embodiment where a transition pattern of clock-embedded blank data is differently implemented in transfer lines, in a clock-embedded interface device according to the present disclosure.
Figure 16:
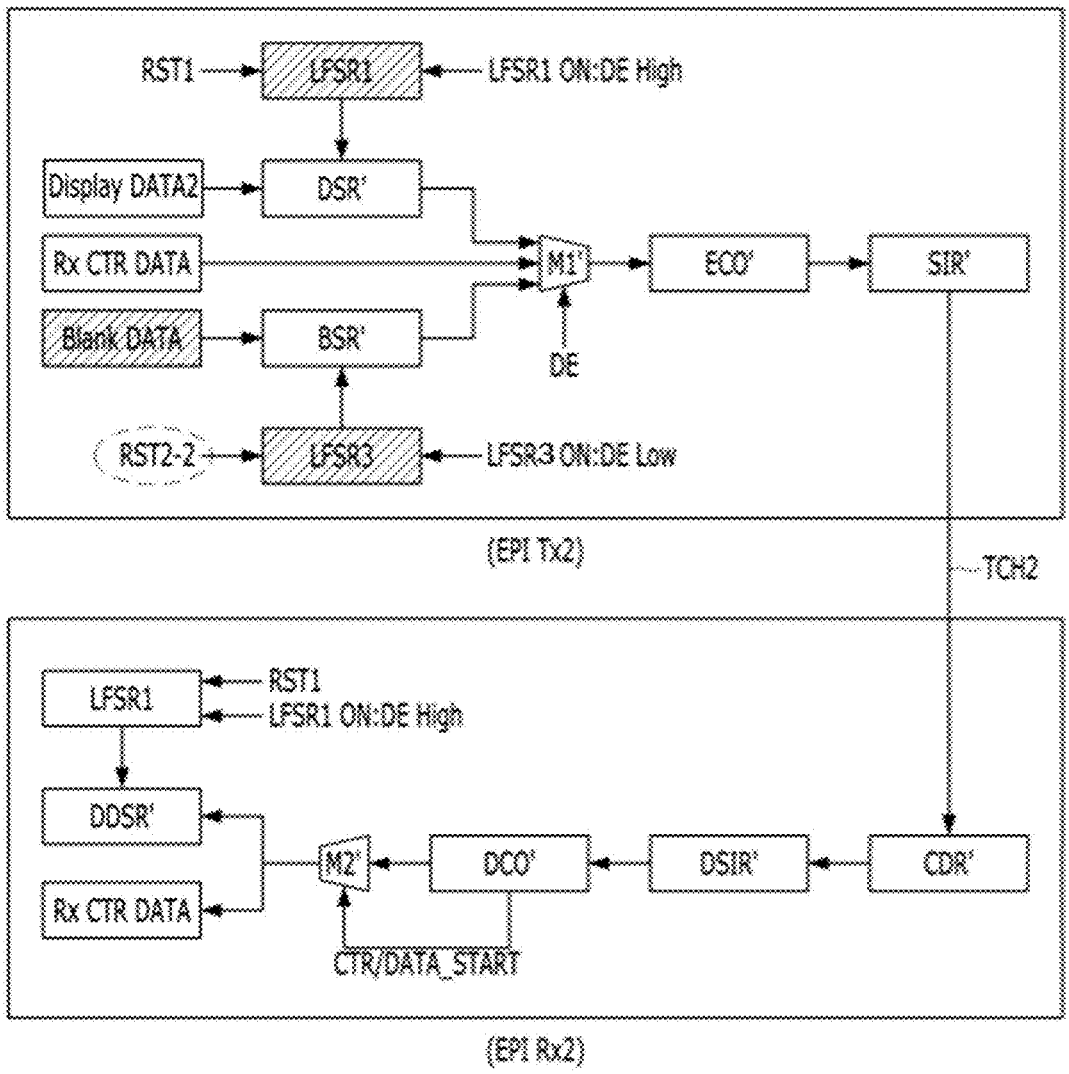

FIGS. 15 and 16 are diagrams illustrating a third embodiment where a transition pattern of clock-embedded blank data is differently implemented in transfer lines, in a clock-embedded interface device according to the present disclosure.

Referring to FIGS. 15 and 16, the clock-embedded interface device according to the third embodiment may include a first transfer circuit (EPI Tx1) and a first reception circuit (EPI Rx1), which are connected to each other through a first transfer line TCH1, and a second transfer circuit (EPI Tx2) and a second reception circuit (EPI Rx2) which are connected to each other through a second transfer line TCH2.

Referring to FIG. 15, the first transfer circuit (EPI Tx1) may encode first clock-embedded image data corresponding to a logic high period of a data enable signal DE and first clock-embedded blank data corresponding to a logic low period of the data enable signal DE and may transfer an encoded first data transfer packet to the first transfer line TCH1.

Referring to FIG. 15, the first transfer circuit (EPI Tx1) may include a first linear feedback shifter register LFSR1, a first image scramble circuit DSR, a second linear feedback shifter register LFSR2, a first blank scramble circuit BSR, a first multiplexer M1, a first encoding circuit ECO, and a first serialization circuit SIR.

Referring to FIG. 16, the second transfer circuit (EPI Tx2) may encode the second clock-embedded image data corresponding to the logic high period of the data enable signal DE and the second clock-embedded blank data corresponding to the logic low period of the data enable signal DE and may transfer an encoded second data transfer packet to the second transfer line TCH2.

Referring to FIG. 16, the second transfer circuit (EPI Tx2) may include the first linear feedback shifter register LFSR1, a second image scramble circuit DSR', a third linear feedback shifter register LFSR3, a second blank scramble circuit BSR', a third multiplexer M1', a second encoding circuit ECO', and a second serialization circuit SIR'.

As described above, the second linear feedback shifter registers LFSR2 respectively included in the first transfer circuit (EPI Tx1) of FIG. 6 and the second transfer circuit (EPI Tx2) of FIG. 7 may output the same linear feedback information based on the same seed signal RST2. The first blank scramble circuit BSR and the second blank scramble circuit BSR' respectively included in the first transfer circuit (EPI Tx1) of FIG. 6 and the second transfer circuit (EPI Tx2) of FIG. 7 may combine pieces of blank data (Blank DATA1) and (Blank DATA2) having different sizes with the same linear feedback information to generate first and second clock-embedded blank data including different transitions.

On the other hand, the second and third linear feedback shifter registers LFSR2 and LFSR3 respectively included in the first transfer circuit (EPI Tx1) of FIG. 15 and the second transfer circuit (EPI Tx2) of FIG. 16 may output the second and third linear feedback information having different sizes based on different seed signals RST2-1 and RST2-2, and thus, may have a difference with the first transfer circuit (EPI Tx1) of FIG. 6 and the second transfer circuit (EPI Tx2) of FIG. 7.

Moreover, the first and second blank scramble circuits BSR and BSR' respectively included in the first transfer circuit (EPI Tx1) of FIG. 15 and the second transfer circuit (EPI Tx2) of FIG. 16 may receive pieces of blank data (Blank DATA) having the same size and may combine second and third linear feedback information having different sizes with the pieces of blank data (Blank DATA) having the same size to generate first and second clock-embedded blank data including different transition patterns, and thus, may have a difference with the first transfer circuit (EPI Tx1) of FIG. 6 and the second transfer circuit (EPI Tx2) of FIG. 7. Pieces of blank data (Blank DATA) having the same size may be referred to as common blank data.

In the clock-embedded interface device according to the third embodiment, sizes of pieces of blank data applied to respective transfer circuits may be the same and a transition pattern of clock-embedded blank data may be differently generated for each transfer circuit, and thus, the convenience of design associated with blank data may be enhanced.

In the first transfer circuit (EPI Tx1) of FIG. 15 and the second transfer circuit (EPI Tx2) of FIG. 16, the elements other than the first and second blank scramble circuits BSR and BSR' and the second and third linear feedback shifter registers LFSR2 and LFSR3 may be substantially the same as corresponding elements of FIGS. 6 and 7.

Moreover, the first transfer circuit (EPI Tx1) of FIG. 15 may be substantially the same as the first transfer circuit (EPI Tx1) of FIG. 6. Also, the second transfer circuit (EPI Tx2) of FIG. 16 may be substantially the same as the second transfer circuit (EPI Tx2) of FIG. 7.

Figure 17:
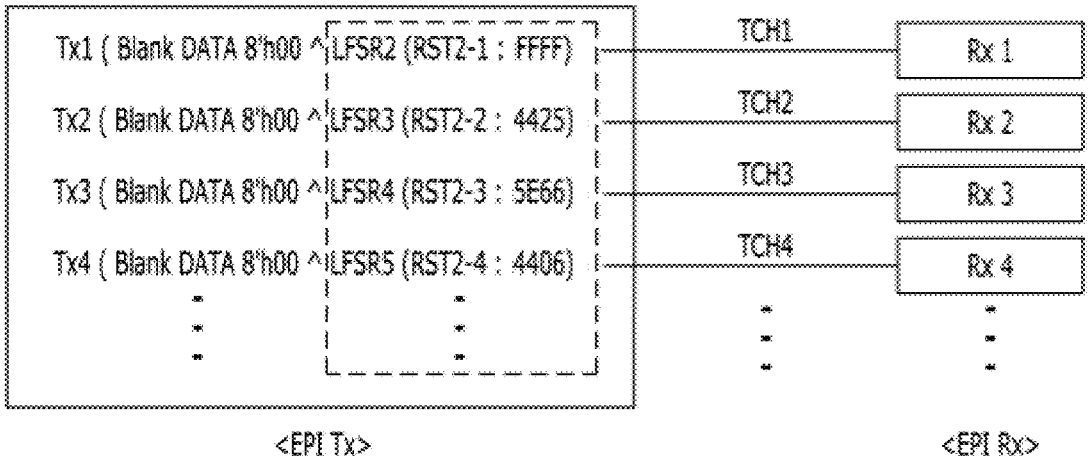

FIGS. 17 and 18 are diagrams illustrating an embodiment where a transition pattern of clock-embedded blank data corresponding to each transfer line is differentially designed, in a clock-embedded interface device according to a third embodiment of the present disclosure.

Referring to FIGS. 17 and 18, first to fourth transfer circuits (EPI Tx1 to EPI Tx4) respectively connected to first to fourth transfer lines TCH1 to TCH4 may receive blank data having the same size, and thus, the convenience of design may increase. However, linear feedback shifter registers LFSR2 to LFSR5 included in the first to fourth transfer circuits (EPI Tx1 to EPI Tx4) may be designed to operate based on different seed signals RST2-1 to RST2-4, so that transition patterns of pieces of clock-embedded blank data, respectively included in first to fourth data transfer packets which are to be transferred through the first to fourth transfer lines TCH1 to TCH4, differ for each data transfer packet. For example, the seed signals RST2-1 to RST2-4 of the linear feedback shifter registers LFSR2 to LFSR5 included in the first to fourth transfer circuits (EPI Tx1 to EPI Tx4) may be respectively and differentially designed as FFFF, 4425, 5E66, and 4406.

As in FIG. 18, in a case where blank data (Blank DATA) input to the first to fourth transfer circuits (EPI Tx1 to EPI Tx4) in common is 8'h00, when the seed signals RST2-1 to RST2-4 of the linear feedback shifter registers LFSR2 to LFSR5 included in the first to fourth transfer circuits (EPI Tx1 to EPI Tx4) are FFFF, 4425, 5E66, and 4406 and differ, an upper 8 bit combination result [15, 8] between the same blank data and pieces of different linear feedback information may differ in the first to fourth transfer circuits (EPI Tx1 to EPI Tx4). In other words, scramble data (i.e., transition patterns of first to fourth clock-embedded blank data) in the first to fourth transfer circuits (EPI Tx1 to EPI Tx4) may differ in the first to fourth transfer circuits (EPI Tx1 to EPI Tx4).

[Fourth Embodiment]

Figure 19:
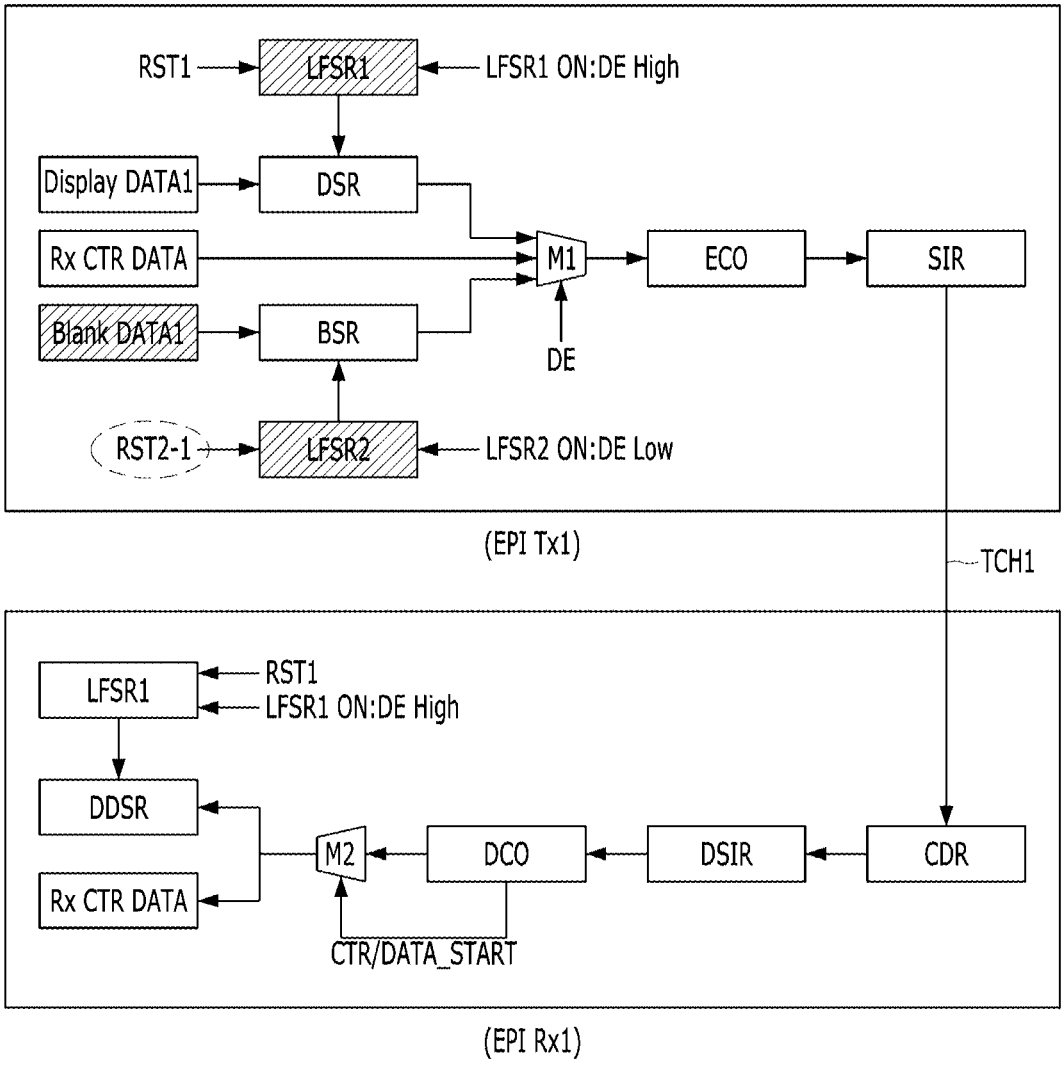
FIGS. 19 and 20 are diagrams illustrating a fourth embodiment where a transition pattern of clock-embedded blank data is differently implemented in transfer lines, in a clock-embedded interface device according to the present disclosure.
Figure 20:
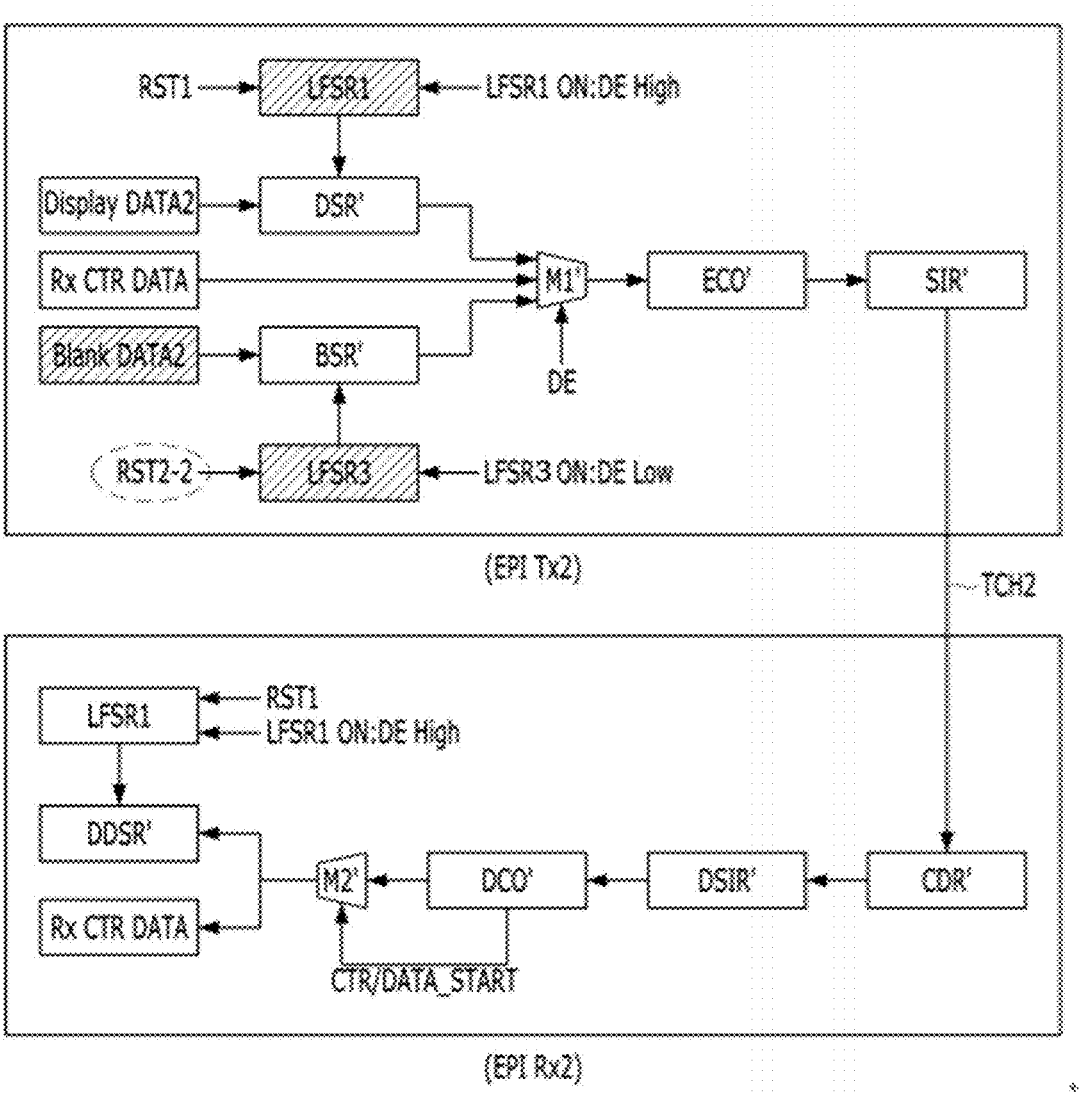

FIGS. 19 and 20 are diagrams illustrating a fourth embodiment where a transition pattern of clock-embedded blank data is differently implemented in transfer lines, in a clock-embedded interface device according to the present disclosure.

Referring to FIGS. 19 and 20, the clock-embedded interface device according to the fourth embodiment may include a first transfer circuit (EPI Tx1) and a first reception circuit (EPI Rx1), which are connected to each other through a first transfer line TCH1, and a second transfer circuit (EPI Tx2) and a second reception circuit (EPI Rx2) which are connected to each other through a second transfer line TCH2.

Referring to FIG. 19, the first transfer circuit (EPI Tx1) may encode first clock-embedded image data corresponding to a logic high period of a data enable signal DE and first clock-embedded blank data corresponding to a logic low period of the data enable signal DE and may transfer an encoded first data transfer packet to the first transfer line TCH1.

Referring to FIG. 19, the first transfer circuit (EPI Tx1) may include a first linear feedback shifter register LFSR1, a first image scramble circuit DSR, a second linear feedback shifter register LFSR2, a first blank scramble circuit BSR, a first multiplexer M1, a first encoding circuit ECO, and a first serialization circuit SIR.

Referring to FIG. 20, the second transfer circuit (EPI Tx2) may encode the second clock-embedded image data corresponding to the logic high period of the data enable signal DE and the second clock-embedded blank data corresponding to the logic low period of the data enable signal DE and may transfer an encoded second data transfer packet to the second transfer line TCH2.

Referring to FIG. 20, the second transfer circuit (EPI Tx2) may include the first linear feedback shifter register LFSR1, a second image scramble circuit DSR', a third linear feedback shifter register LFSR3, a second blank scramble circuit BSR', a third multiplexer M1', a second encoding circuit ECO', and a second serialization circuit SIR'.

As described above, the second linear feedback shifter registers LFSR2 respectively included in the first transfer circuit (EPI Tx1) of FIG. 6 and the second transfer circuit (EPI Tx2) of FIG. 7 may output the same linear feedback information based on the same seed signal RST2. The first blank scramble circuit BSR and the second blank scramble circuit BSR' respectively included in the first transfer circuit (EPI Tx1) of FIG. 6 and the second transfer circuit (EPI Tx2) of FIG. 7 may combine pieces of blank data (Blank DATA1) and (Blank DATA2) having different sizes with the same linear feedback information to generate first and second clock-embedded blank data including different transitions.

On the other hand, the second and third linear feedback shifter registers LFSR2 and LFSR3 respectively included in the first transfer circuit (EPI Tx1) of FIG. 19 and the second transfer circuit (EPI Tx2) of FIG. 20 may output the second and third linear feedback information having different sizes based on different seed signals RST2-1 and RST2-2, and thus, may have a difference with the first transfer circuit (EPI Tx1) of FIG. 6 and the second transfer circuit (EPI Tx2) of FIG. 7.

Moreover, the first and second blank scramble circuits BSR and BSR' respectively included in the first transfer circuit (EPI Tx1) of FIG. 19 and the second transfer circuit (EPI Tx2) of FIG. 20 may receive pieces of blank data (Blank DATA1) and (Blank DATA2) having different sizes and may combine second and third linear feedback information having different sizes with the pieces of blank data (Blank DATA1) and (Blank DATA2) having different sizes to generate first and second clock-embedded blank data including different transition patterns, and thus, may have a difference with the first transfer circuit (EPI Tx1) of FIG. 6 and the second transfer circuit (EPI Tx2) of FIG. 7.

In the clock-embedded interface device according to the fourth embodiment, sizes of pieces of blank data applied to respective transfer circuits may differ and seed signals applied to respective transfer circuits may differ, and thus, transition patterns of pieces of clock-embedded blank data may be more easily and differentially implemented.

In the first transfer circuit (EPI Tx1) of FIG. 19 and the second transfer circuit (EPI Tx2) of FIG. 20, the elements other than the first and second blank scramble circuits BSR and BSR' and the second and third linear feedback shifter registers LFSR2 and LFSR3 may be substantially the same as corresponding elements of FIGS. 6 and 7.

Moreover, the first transfer circuit (EPI Tx1) of FIG. 19 may be substantially the same as the first transfer circuit (EPI Tx1) of FIG. 6. Also, the second transfer circuit (EPI Tx2) of FIG. 20 may be substantially the same as the second transfer circuit (EPI Tx2) of FIG. 7.

The embodiments of the present disclosure may realize the following effects.

According to the embodiments of the present disclosure, in a clock-embedded interface device based on the coding scheme, a transition pattern of blank data transferred for a CDR operation may be differently implemented in transfer lines, and thus, EMI and power consumption may be reduced.

The effects according to the present disclosure are not limited to the above examples, and other various effects may be included in the specification.

It will be apparent to those skilled in the art that various modifications and variations can be made in the data interface device and the method of display apparatus of the present disclosure without departing from the technical idea or scope of the disclosure. Thus, it is intended that the present disclosure cover the modifications and variations of this disclosure provided they come within the scope of the appended claims and their equivalents.

What is claimed is:

1. A data interface device of a display apparatus, the data interface device comprising:

a first transfer circuit encoding first clock-embedded image data corresponding to a logic high period of a data enable signal and first clock-embedded blank data corresponding to a logic low period of the data enable signal and transferring an encoded first data transfer packet to a first transfer line;

a first reception circuit generating a first internal clock based on the encoded first data transfer packet received through the first transfer line and decoding the first clock-embedded image data based on the first internal clock;

a second transfer circuit encoding second clock-embedded image data corresponding to the logic high period of the data enable signal and second clock-embedded blank data corresponding to the logic low period of the data enable signal and transferring an encoded second data transfer packet to a second transfer line; and a second reception circuit generating a second internal clock based on the encoded second data transfer packet received through the second transfer line and decoding the second clock-embedded image data based on the second internal clock, wherein a first transition pattern of the first clock-embedded blank data differs from a second transition pattern of the second clock-embedded blank data.

2. The data interface device of claim 1, wherein the first transfer circuit comprises:

a first linear feedback shifter register outputting first linear feedback information based on a first seed signal in the logic high period of the data enable signal;

a first image scramble circuit combining and scrambling first image data and the first linear feedback information to generate the first clock-embedded image data;

a second linear feedback shifter register outputting second linear feedback information based on a second seed signal differing from the first seed signal in the logic low period of the data enable signal; and a first blank scramble circuit combining and scrambling first blank data and the second linear feedback information to generate the first clock-embedded blank data.

3. The data interface device of claim 2, wherein the second transfer circuit comprises:

a second image scramble circuit combining and scrambling second image data and the first linear feedback information to generate the second clock-embedded image data; and a second blank scramble circuit combining and scrambling the second linear feedback information and second blank data differing from the first blank data to generate the second clock-embedded blank data.

4. The data interface device of claim 1, wherein the first transfer circuit comprises:

a first linear feedback shifter register outputting first linear feedback information based on a seed signal in the logic high period of the data enable signal;

a first image scramble circuit combining and scrambling first image data and the first linear feedback information to generate the first clock-embedded image data;

a second linear feedback shifter register outputting second linear feedback information without a designated seed signal in the logic low period of the data enable signal; and a first blank scramble circuit combining and scrambling first blank data and the second linear feedback information to generate the first clock-embedded blank data.

5. The data interface device of claim 4, wherein the second transfer circuit comprises:

a second image scramble circuit combining and scrambling second image data and the first linear feedback information to generate the second clock-embedded image data; and a second blank scramble circuit combining and scrambling the second linear feedback information and second blank data differing from the first blank data to generate the second clock-embedded blank data.

6. The data interface device of claim 1, wherein the first transfer circuit comprises:

a first linear feedback shifter register outputting first linear feedback information based on a first seed signal in the logic high period of the data enable signal;

a first image scramble circuit combining and scrambling first image data and the first linear feedback information to generate the first clock-embedded image data;

a second linear feedback shifter register outputting second linear feedback information based on a second seed signal differing from the first seed signal in the logic low period of the data enable signal; and a first blank scramble circuit combining and scrambling common blank data and the second linear feedback information to generate the first clock-embedded blank data.

7. The data interface device of claim 6, wherein the second transfer circuit comprises:

the first linear feedback shifter register;

a second image scramble circuit combining and scrambling second image data and the first linear feedback information to generate the second clock-embedded image data;

a third linear feedback shifter register outputting third linear feedback information based on a third seed signal differing from the second seed signal in the logic low period of the data enable signal; and a second blank scramble circuit combining and scrambling the common blank data and the third linear feedback information to generate the second clock-embedded blank data.

8. The data interface device of claim 2, wherein the second transfer circuit comprises:

a second image scramble circuit combining and scrambling second image data and the first linear feedback information to generate the second clock-embedded image data;

a third linear feedback shifter register outputting third linear feedback information based on a third seed signal differing from the second seed signal in the logic low period of the data enable signal; and a second blank scramble circuit combining and scrambling the third linear feedback information and second blank data differing from the first blank data to generate the second clock-embedded blank data.

9. The data interface device of claim 1, wherein the first reception circuit selectively decodes and descrambles the first clock-embedded image data in the encoded first data transfer packet received through the first transfer line to recover first image data included in the first clock-embedded image data, and the second reception circuit selectively decodes and descrambles the second clock-embedded image data in the encoded second data transfer packet received through the second transfer line to recover second image data included in the second clock-embedded image data.

10. The data interface device of claim 1, wherein the first and second transfer circuits and the first and second reception circuits are connected to a common linear feedback shifter register which outputs a same linear feedback information, and the common linear feedback shifter register outputs common linear feedback information based on a same seed signal in the logic high period of the data enable signal.

11. A data interface device of a display apparatus, the data interface device comprising:

a timing controller encoding clock-embedded image data corresponding to a logic high period of a data enable signal and clock-embedded blank data corresponding to a logic low period of the data enable signal and transferring an encoded data transfer packet to a transfer line; and a source integrated circuit generating an internal clock based on the encoded data transfer packet received through the transfer line and selectively decoding the clock-embedded image data based on the internal clock, wherein a transition pattern of the clock-embedded blank data differs in a plurality of transfer lines.

12. The data interface device of claim 11, further comprising:

a linear feedback shifter register, outputting linear feedback information based on a seed signal in the logic low period of the data enable signal, and a first transfer circuit and a second transfer circuit respectively connected to a first transfer line and a second transfer line, wherein the first transfer circuit comprises a first blank scramble circuit combining and scrambling first blank data and the linear feedback information to generate first clock-embedded blank data, and wherein the second transfer circuit comprises a second blank scramble circuit combining and scrambling the linear feedback information and second blank data differing from the first blank data to generate second clock-embedded blank data including a transition pattern that differs from a transition pattern of the first clock-embedded blank data.

13. The data interface device of claim 11, further comprising:

a linear feedback shifter register, outputting linear feedback information without a designated seed signal in the logic low period of the data enable signal, and a first transfer circuit and a second transfer circuit respectively connected to a first transfer line and a second transfer line, wherein the first transfer circuit comprises a first blank scramble circuit combining and scrambling first blank data and the linear feedback information to generate first clock-embedded blank data, and wherein the second transfer circuit comprises a second blank scramble circuit combining and scrambling the linear feedback information and second blank data differing from the first blank data to generate second clock-embedded blank data including a transition pattern that differs from a transition pattern of the first clock-embedded blank data.

14. The data interface device of claim 11, further comprising:

a first transfer circuit and a second transfer circuit respectively connected to a first transfer line and a second transfer line, wherein the first transfer circuit comprises a first linear feedback shifter register, outputting first linear feedback information based on a first seed signal in the logic low period of the data enable signal, and a first blank scramble circuit combining and scrambling common blank data and the first linear feedback information to generate first clock-embedded blank data, and wherein the second transfer circuit comprises a second linear feedback shifter register, outputting second linear feedback information based on a second seed signal differing from the first seed signal in the logic low period of the data enable signal, and a second blank scramble circuit combining and scrambling the common blank data and the second linear feedback information to generate second clock-embedded blank data including a transition pattern that differs from a transition pattern of the first clock-embedded blank data.

15. The data interface device of claim 11, further comprising:

a first transfer circuit and a second transfer circuit respectively connected to a first transfer line and a second transfer line, wherein the first transfer circuit comprises a first linear feedback shifter register, outputting first linear feedback information based on a first seed signal in the logic low period of the data enable signal, and a first blank scramble circuit combining and scrambling first blank data and the first linear feedback information to generate first clock-embedded blank data, and wherein the second transfer circuit comprises a second linear feedback shifter register, outputting second linear feedback information based on a second seed signal differing from the first seed signal in the logic low period of the data enable signal, and a second blank scramble circuit combining and scrambling the second linear feedback information and second blank data differing from the first blank data to generate second clock-embedded blank data including a transition pattern which differs from a transition pattern of the first clock-embedded blank data.

16. A data interface method of a display apparatus, the data interface method comprising:

encoding clock-embedded image data corresponding to a logic high period of a data enable signal and clock-embedded blank data corresponding to a logic low period of the data enable signal, and transferring an encoded data transfer packet to a transfer line; and generating an internal clock based on the encoded data transfer packet received through the transfer line and selectively decoding the clock-embedded image data based on the internal clock, wherein a transition pattern of the clock-embedded blank data differs in a plurality of transfer lines.

* * * * *